US008955342B2

(12) United States Patent
Cording

(10) Patent No.: US 8,955,342 B2
(45) Date of Patent: Feb. 17, 2015

(54) REFRIGERATION SYSTEM AND METHOD OF OPERATING A REFRIGERATION SYSTEM

(75) Inventor: Louis Cording, Sonderborg (DK)

(73) Assignee: Mahle Clevite Inc., Ann Arbor, MI (US)

( * ) Notice: Subject to any disclaimer, the term of this patent is extended or adjusted under 35 U.S.C. 154(b) by 244 days.

(21) Appl. No.: 13/593,751

(22) Filed: Aug. 24, 2012

(65) Prior Publication Data

US 2013/0047637 A1 Feb. 28, 2013

(30) Foreign Application Priority Data

Aug. 24, 2011 (EP) ..... 11178644

(51) Int. Cl.
*F25B 45/00* (2006.01)

(52) U.S. Cl.
CPC ..... *F25B 45/00* (2013.01); *F25B 2345/001* (2013.01); *F25B 2345/002* (2013.01); *F25B 2400/121* (2013.01)
USPC ..... 62/77; 62/149; 62/292

(58) Field of Classification Search
CPC ..... F25B 45/00; F25B 2400/121; F25B 2345/002; F25B 2345/001
USPC ..... 62/77, 149, 292, 129, 157, 509
See application file for complete search history.

(56) References Cited

U.S. PATENT DOCUMENTS 4,285,206 A 8/1981 Koser
5,289,693 A * 3/1994 Major et al. ..... 62/149
5,497,635 A * 3/1996 Alsenz ..... 62/502
5,802,860 A * 9/1998 Barrows ..... 62/126
5,806,329 A * 9/1998 Taira et al. ..... 62/149
6,862,894 B1 * 3/2005 Miles ..... 62/238.6
8,181,480 B2 * 5/2012 Kasahara et al. ..... 62/498
2007/0234753 A1 * 10/2007 Nemoto et al. ..... 62/335
2010/0050674 A1 * 3/2010 Kasahara et al. ..... 62/222
2010/0180612 A1 * 7/2010 Kasahara et al. ..... 62/225
2011/0036104 A1 * 2/2011 Toyoshima et al. ..... 62/77

FOREIGN PATENT DOCUMENTS

EP 2 136 164 12/2009
JP 11-23115 1/1999
JP 2006-10117 1/2006
WO WO 2005/078364 8/2005
WO WO 2006/066580 6/2006
WO WO 2011/088831 7/2011

* cited by examiner

*Primary Examiner* — Mohammad M Ali
(74) *Attorney, Agent, or Firm* — Rader, Fishman & Grauer PLLC

(57) ABSTRACT

A method of operating a filling system, which is configured for transferring a refrigerant to a refrigeration system and comprises a receiver for collecting a refrigerant-air-mixture, comprises the steps of determining the saturation pressure of the refrigerant at the actual environmental conditions; determining the air pressure of the refrigerant-air-mixture within the receiver; and stopping the operation of the filling system and/or issuing an alarm if the air pressure of the refrigerant-air-mixture within the receiver exceeds the saturation pressure of the refrigerant by more than a predetermined margin or if the change of the air pressure within the refrigerant-air-mixture within the receiver over time exceeds a predetermined margin.

18 Claims, 1 Drawing Sheet

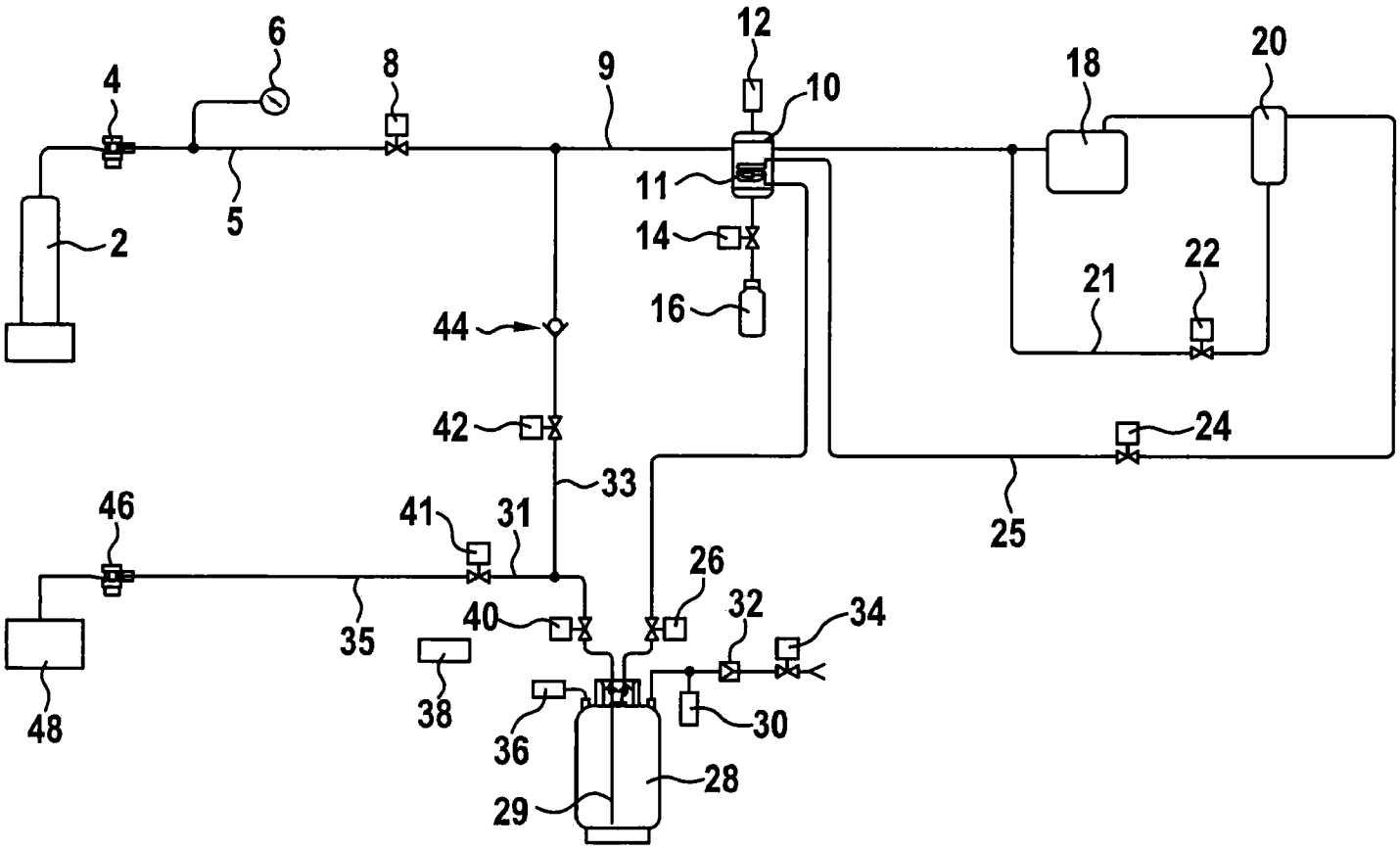
2
4
5
6
8
9
10
11
12
14
16
18
20
21
22
24
25
26
28
29
30
31
32
33
34
35
36
38
40
41
42
44
46
48

REFRIGERATION SYSTEM AND METHOD OF OPERATING A REFRIGERATION SYSTEM

CROSS REFERENCE

The present application claims the benefit under 35 U.S.C. §119 of European Patent Application No. EP 11178644.8 filed on Aug. 24, 2011, which is expressly incorporated herein by reference in its entirety.

FIELD OF THE INVENTION

The present invention is directed to a refrigeration system and method of safely operating a refrigeration system by avoiding explosive conditions within the refrigeration system.

BACKGROUND INFORMATION

In the past, a common refrigerant used in refrigeration systems has been 1,1,1,2-tetrafluoroethane, which is commonly known as R134a. However, owing to the 15 high green house effect potential (GWP, Global Warming Potential) of R134a, it is not allowed to use R134a as a coolant in new vehicles anymore.

A substitute coolant, which is known as R1234yf and which has a permissible low GWP value has been developed, which, unfortunately, is inflammable. The service stations used for the filling, emptying and flushing of the new inflammable coolant must therefore fulfill the ATEX Directive 94/9/EU concerning equipment and protective systems intended for use in potentially explosive atmospheres or inflammable atmospheres. This EU directive, in short ATEX, implies that the service station used for the filling and emptying of NC systems, especially mobile A/C systems in vehicles, must comply with considerable technical requirements when the inflammable coolant is to be added to the NC system, or when service is performed on the NC systems containing the inflammable coolant.

In accordance with ATEX, a zone 2 is classified as an area in which, normally, no inflammable atmosphere is present—only in case of an accident, and then only briefly. Zone 2 is the lowest area classification according to ATEX.

A component which contains an inflammable medium and also has a connection or a gasket, which is not technically tight, is considered to have a zone 2 in a radius of 1 m around the connection or gasket. A gasket is normally tight, but may become leaky because of wear and/or ageing. Therefore, according to AT EX, a zone 2 atmosphere will by definition be present around the gasket.

When maintenance is performed on A/C systems, the coolant is evacuated from the A/C system prior to service or repair. The evacuation is normally performed by suction.

When performing service and/or repair on A/C systems operating with an inflammable coolant, the service systems must therefore be suitable for use in a zone 2 environment according to ATEX. In other words, zone 2 requirements should be fulfilled at least inside the service station.

In those cases where the A/C system includes components which are to be replaced, there is a procedure where the oil and/or particulates content in the component itself, or in the entire air conditioning system, has to be flushed out by means of a so-called flushing process. So far, so-called flushing kits have been used for this, said kits being supplied to the service stations as "add-ons" for mounting between the A/C system and the service station during the flushing process. With the prior art technology, as mentioned, the flushing kit is mounted between the mobile A/C system and the service station. The primary purpose of this flushing kit is to catch all the coolant which is flushed through the A/C system from the service station in liquid form, as well as the oil and any solids or particulates which are entrained by the flushing flow of the coolant. After collection, it is then the task of the service station to empty the coolant from the accumulator of the flushing kit in gas form, thereby leaving the oil in the accumulator. Conventional service stations for mobile for A/C systems usually contain their own suction accumulator, a heated suction accumulator, which basically has the same function as these flushing accumulators in the flushing kits—they are just smaller, since they are not intended to receive any large amounts of coolant and also just smaller amounts of oil when a normal service is carried out on a mobile A/C system, i.e., when the Me system is only to be emptied.

Since, however, the new coolant is inflammable, this flushing kit will have to comply with the special requirements in ATEX, which also apply to the service station, since a zone 2 will be present around every connection, i.e., also around the connections between the external flushing kit and the service station.

One possible solution would be to use only components suitable for explosive zones according to the requirements of the ATEX directive. This, however, would increase the costs of the refrigeration system considerably.

SUMMARY

It is an object of the present invention to provide a system for transferring a refrigerant to a refrigeration system and method of operating a filling system for safely transferring a refrigerant to a refrigeration system allowing to reliably avoid explosive conditions at low costs.

An example method of operating a filling system comprising a receiver for collecting a refrigerant-air-mixture comprises the steps of determining the saturation pressure of the refrigerant at the actual environmental conditions; determining the air pressure of the refrigerant-air-mixture within the receiver; and stopping the operation of the filling system and/or issuing an alarm if the air pressure of the refrigerant-air-mixture within the receiver exceeds the saturation pressure of the refrigerant by more than a predetermined margin or if the change of the air pressure of the refrigerant-air-mixture within the receiver over time exceeds a predetermined margin.

An example filling system for transferring refrigerant to a refrigeration system according to an embodiment of the present invention comprises a receiver for collecting a refrigerant-air-mixture, a pressure sensor for measuring the pressure in the receiver, a temperature sensor for measuring the temperature of the refrigerant-air-mixture in the receiver, and a control unit which is configured to determine based on the pressure and the temperature measured by the pressure sensor and the temperature sensor the saturation pressure of the refrigerant and the air pressure of the refrigerant-air-mixture within the receiver and to stop the operation of the filling system and/or to issue an alarm if the air pressure of the refrigerant-air-mixture within the receiver exceeds the saturation pressure of the refrigerant by more than a predetermined margin.

Alternatively, the operation of the filling system is stopped and/or an alarm is issued if the change of the air pressure of the refrigerant-air-mixture within the receiver as a function of time exceeds a predetermined margin. A fast change of the air pressure of the refrigerant-air-mixture is a reliable indicator for a leak or another problem in the system and a state in which the ratio of air in the refrigerant-air-mixture approaches an explosive state may be detected early and reliably.

The flammability area of a typical refrigerant as, e.g., R1234yf is 6.2-12.3% in air.

The gas-pressure in a typical refrigeration system is usually between 4 bar and 15 bar.

Thus, if a flammability refrigerant-air-mixture is to be found inside the system, the 5 air-pressure necessary to create such mixtures can be found from the equations:

Lower Limit: 4 bar: 4 bar/(4 bar+60.5 barAir)=6.2% in Air

Upper Limit: 15 bar: 15 bar/(15 bar+107 barAir) =12.3% in Air

In other words, the air-pressure must be between 60.5 bar and 107 bar in order to provide an explosive refrigerant-air-mixture.

Such high air pressures cannot be created inside the system. Thus, if no other circumstances were relevant, this would be a safe condition.

However, the range of the flammability area may change under pressure. Therefore, it is good practice to utilize a very big safety margin. This is the case by using, e.g., 1.7 bar air pressure as the predetermined margin providing a very big safety margin towards the explosive area of 60.S bar to 107 bar.

In an example embodiment, determining the saturation pressure of the refrigerant includes determining the temperature of the refrigerant. Knowing the temperature of the refrigerant allows to determine the saturation pressure of the refrigerant.

In an embodiment determining the air pressure of the refrigerant-air-mixture within the receiver includes the steps of determining the total pressure within the receiver, determining the refrigerant pressure within the receiver and determining the air pressure of the refrigerant-air-mixture from the total pressure and the refrigerant pressure. This provides a convenient and reliable method for determining the air pressure of the refrigerant-air-mixture which is easy to implement.

In an example embodiment, the total pressure within the receiver is determined by means of a pressure sensor. This provides the easiest way for determining the pressure within the receiver.

In an embodiment, the refrigerant pressure is determined by measuring the temperature of the refrigerant-air-mixture. Measuring the temperature of the refrigerant-air-mixture provides an easy and reliable method for determining the refrigerant pressure in the refrigerant-air-mixture.

In an embodiment, the operation of the filling system is stopped if the air pressure of the refrigerant-air-mixture within the receiver exceeds the saturation pressure of the refrigerant by more than a predetermined first margin. This provides additional safety as the operation is stopped before the air pressure of the refrigerant-air-mixture reaches a value at which the refrigerant-air-mixture becomes explosive.

By releasing air from the receiver the air pressure within the receiver may lobe reduced in order to avoid that the air-pressure increases to the explosive region.

In an example embodiment, an alarm is issued if the air pressure of the refrigerant-air-mixture within the receiver exceeds the saturation pressure of the refrigerant by more than a predetermined second margin. This provides additional safety as an operator is notified when the refrigerant-air-mixture approaches an explosive state.

In an example embodiment, the first margin is smaller than the second margin. Thus, the operation of the system is stopped for reasons of safety, but no alarm is triggered as the air pressure of the refrigerant-air-mixture has not yet reached a value at which the refrigerant-air-mixture becomes explosive.

In an example embodiment, the first margin is 1.0 bar. A margin of 1.0 bar above the saturation pressure of the refrigerant has been identified as suitable for switching off the system in order to avoid that the refrigerant-air-mixture reaches a value at which the refrigerant-air-mixture becomes explosive without unnecessarily shutting down the system to many times.

In an example embodiment, the second margin is 1.7 bar. A distance of 0.7 bar between the first margin and the second margin has been proven as very suitable for triggering an alarm if necessary without causing a to large number of false alarms.

The present invention is described in more detail below.

BRIEF DESCRIPTION OF THE DRAWING

The FIGURE shows a schematic view of an example embodiment of a system according to the present invention.

DETAILED DESCRIPTION OF EXAMPLE EMBODIMENTS

An external pressure bottle 2 filled with a fluid refrigerant to be supplied to the refrigeration unit 48 is connected by means of a system inlet (low pressure) coupling 4 to a charging hose 5 of the filling system. The charging hose 5 is provided with an inlet pressure sensor 6 which is configured to measure the pressure of the refrigerant supplied by the external pressure bottle 2 to the inlet hose 5.

The opposing end of the inlet hose 5 is connected by means of a switchable inlet valve 8 to an inlet line 9 which supplies the refrigerant delivered by the external pressure bottle 2 to a heated suction accumulator 10. The heated suction accumulator 10 is configured to heat the refrigerant, if necessary, in order to ensure that all the refrigerant is vaporized. A heated suction accumulator pressure sensor 12 is located at the heated suction accumulator 10 in order to measure the pressure of the refrigerant collected within the heated suction accumulator 10.

An oil drain valve 14 and an oil drain 16 are serially connected to the bottom of the heated suction accumulator 10 in order to drain oil, which has been separated from the refrigerant within the heated suction accumulator 10 and collected at the bottom of the heated suction accumulator 10.

An outlet side of the heated suction accumulator 10 is fluidly connected to a low pressure inlet of a compressor 18, the compressor 18 being configured for compressing the refrigerant to an increased pressure level.

A high pressure outlet side of the compressor 18 provides pressurized refrigerant and is fluidly connected to an oil separator 20 which is configured for separating oil, which is used for lubricating the compressor 20 and a portion of which is added to the refrigerant in the compressor 18, from the refrigerant. The oil separated by the oil separator 20 is delivered via an oil return line 21 and an oil return valve 22 back to the inlet side of the compressor 18 in order to avoid that the compressor 18 runs out of oil after some time of operation. The compressor 18 running out of oil could result in a jamming and/or even serious damage of the compressor 18.

The refrigerant leaving the oil separator 20 flows through a high pressure line 25 comprising a compressor outlet valve 24 to a heating coil 11, which is arranged within the heated suction accumulator 10 in order to transfer heat from the high pressurized, high temperature refrigerant leaving the compressor 18 to the low pressure refrigerant before it flows into the compressor 18, in order to ensure that only vaporized refrigerant enters into the compressor 18, as it has been described before.

After having left the heating coil 11, the refrigerant is delivered via a receiver inlet valve 26 into a receiver 28 of the system. The receiver 28 is provided with an receiver temperature sensor 36, which is configured for measuring the temperature of the refrigerant collected within the receiver 28.

The receiver 28 is further provided with a receiver pressure sensor 30, which is configured for measuring the pressure of the refrigerant collected within the receiver 28. An orifice 32 and a 10 venting valve 34, which are fluidly connected to the receiver 28, allow to vent the receiver 28 by dispensing excessive gas/air from the receiver 28 to the environment.

The receiver 28 is further provided with a receiver outlet line 29 comprising a receiver outlet valve 40 allowing to extract pressurized refrigerant from the receiver 28.

Downstream of the receiver outlet valve 40 the receiver outlet line 29 branches into a system outlet line 31, which is fluidly connected to an refrigeration unit 48 by means of a system outlet valve 41, an outlet hose 35 and a high pressure outlet coupling 46, and a refrigerant return line 33 fluidly connecting the receiver outlet line 29 to the inlet side of the heated suction accumulator 10.

The refrigerant return line 33 comprises a switchable refrigerant return valve 42, which allows to control the flow of refrigerant through the refrigerant return line 33, and a one-way-valve 44, which inhibits an undesired flow of refrigerant from the inlet line 9 to the receiver outlet line 29.

When the system is operated, the pressure and the temperature of the refrigerant-air-mixture collected within the receiver 28 are measured by means of the receiver pressure sensor 30 and the receiver temperature sensor 36, respectively.

The gas pressure of the refrigerant and the air pressure of the refrigerant-air-mixture are determined by a control unit 38 based on the output values of the receiver pressure sensor 30 and the receiver temperature sensor 36.

If the air pressure in the refrigerant-air-mixture exceeds the saturation pressure of the refrigerant by more than a predetermined first margin, for example 1.0 bar, the operation of the control unit 38 will stop the operation of the system and issue a message to an operator indicating an increased air pressure in the system.

If the air pressure of the refrigerant-air-mixture exceeds the saturation pressure 5 of the refrigerant by more than a predetermined second margin, for example 1.7 bar, the control unit 38 will stop the operation of the system and issue an optic and/or acoustic alarm in order to notify an operator that an explosive refrigerant-air-mixture may be present and appropriate countermeasures and/or additional safety measures should be implemented.

In an alternative embodiment the system is stopped and/or an alarm is triggered if the change of the air pressure of the refrigerant-air-mixture within the receiver 38 over time exceeds a predetermined margin. A fast change of the air pressure of the refrigerant-air-mixture is a reliable indicator for a leak or another problem in the system, and a state in which the ratio of air in the refrigerant-air-mixture approaches an explosive state may be detected early and reliably.

Countermeasures and/or additional safety measures may be triggered by the control unit 38 in order to avoid an ignition and/or explosion of the refrigerant-air-mixture. These countermeasures and/or safety measures may include to vent the receiver 28 by dispensing excessive gas/air from the receiver 28 to the environment via the venting valve 34 in order to reduce the pressure within the receiver 28, to switch off all electrical device in the environment of the system and/or to fill the environment of the system with an inflammable gas.

It is to be noted that the mentioned margins of 1.0 bar and 1.7 bar above the saturation pressure, which provide a large safety margin, are only exemplary 30 margins and different margins, which are considered as being appropriate in the special situation, may be used. The selection of the margins may, e.g., depend on the type of refrigerant used, the typical environmental conditions and the actual safety requirements.

The invention claimed is:

1. A method of operating a filling system which is configured for transferring a refrigerant to a refrigeration system, the filling system including a receiver for collecting a refrigerant-air-mixture, the method comprising:

determining a saturation pressure of the refrigerant at actual environmental conditions;

determining air pressure of the refrigerant-air-mixture within the receiver; and at least one of stopping operation of the system, and issuing an alarm, if the air pressure of the refrigerant-air-mixture within the receiver exceeds the saturation pressure of the refrigerant by more than a predetermined margin or if a change of the air pressure of the refrigerant-air-mixture within the receiver over time exceeds a predetermined margin.

2. The method of claim 1, wherein the step of determining the saturation pressure of the refrigerant includes the step of determining a temperature of the refrigerant.

3. The method of claim 1, wherein the step of determining the air pressure of the refrigerant-air-mixture within the receiver includes:

determining total pressure within the receiver;

determining refrigerant pressure within the receiver; and determining the air pressure of the refrigerant-air-mixture from the total pressure and the refrigerant pressure.

4. The method of claim 3, wherein the total pressure within the receiver is determined using a pressure sensor.

5. The method of claim 3, wherein the refrigerant pressure is determined by measuring a temperature of the refrigerant-air-mixture.

6. The method of claim 1, wherein operation of the refrigeration system is stopped if the air pressure of the refrigerant-air-mixture within the receiver exceeds the saturation pressure of the refrigerant by more than a predetermined first margin, and an alarm is issued if the air pressure of the refrigerant-air-mixture within the receiver exceeds the saturation pressure of the refrigerant by more than a predetermined second margin.

7. The method of claim 6, wherein the first margin is smaller than the second margin.

8. The method of claim 6, wherein the first margin is 1.0 bar.

9. The method of claim 6, wherein the second margin is 1.7 bar.

10. The method of claim 2, wherein the step of determining the temperature of the refrigerant comprises determining the temperature of the refrigerant disposed within the receiver.

11. The method of claim 1, further comprising venting the receiver by dispensing an excessive amount of the refrigerant from the receiver to the external environment.

12. The method of claim 11, further comprising switching off an electrical device in the external environment.

13. The method of claim 1, further comprising delivering the refrigerant from a bottle to a heat suction accumulator, and heating the refrigerant in the heat suction accumulator so as to vaporize the refrigerant.

14. The method of claim 13, further delivering the vaporized refrigerant from the heat suction accumulator to the compressor, and compressing the vaporized refrigerant to an increased pressure level.

15. The method of claim 14, further delivering the compressed refrigerant from the compressor to a heating coil in the heat suction accumulator, and transferring heat from the compressed refrigerant to the refrigerant received from the bottle.

16. The method of claim 15, further delivering the compressed refrigerant from the heating coil in the heat suction accumulator to the receiver, and transferring heat from the compressed refrigerant to the refrigerant received from the bottle.

17. A filling system for transferring refrigerant to a refrigeration system, the filling system comprising:

a receiver for collecting a refrigerant-air-mixture;

a pressure sensor for measuring pressure in the receiver;

a temperature sensor for measuring a temperature of the refrigerant-air-mixture in the receiver; and a control unit configured to determine based on the pressure and the temperature respectively measured by the pressure sensor and the temperature sensor a saturation pressure of the refrigerant and the air pressure of the refrigerant-air-mixture within the receiver, and to at least one of stop the operation of the filling system and issue an alarm, if the air pressure of the refrigerant-air-mixture within the receiver exceeds the saturation pressure of the refrigerant by more than a predetermined margin or if a change of air pressure of the refrigerant-air-mixture within the receiver over time exceeds a predetermined margin.

18. The filling system of claim 17, further comprising a venting valve fluidly communicating with the receiver and configured to dispense an excessive amount of the refrigerant from the receiver to the external environment.

* * * * *